US005517825A

United States Patent [19]

Manz et al.

[11] Patent Number: 5,517,825

[45] Date of Patent: May 21, 1996

[54] REFRIGERANT HANDLING SYSTEM AND METHOD WITH AIR PURGE AND SYSTEM CLEARING CAPABILITIES

[75] Inventors: Kenneth W. Manz, Paulding; Sandra Sheehe, Bryan, both of Ohio

[73] Assignee: SPX Corporation, Muskegon, Mich.

[21] Appl. No.: 316,260

[22] Filed: Sep. 30, 1994

[51] Int. Cl.[6] ..... G05D 23/32

[52] U.S. Cl. ..... 62/158; 62/195; 62/475; 62/85

[58] Field of Search ..... 62/85, 149, 195, 62/475, 292, 77, 158, 157, 231, 232

[56] References Cited

U.S. PATENT DOCUMENTS

| | | | |
|---|---|---|---|
| 3,410,106 | 11/1968 | Brockie . | |
| 3,620,038 | 6/1970 | Muench . | |
| 4,441,330 | 4/1984 | Lower et al. . | |
| 4,776,174 | 10/1988 | Rich et al. . | |
| 4,856,289 | 8/1989 | Lofland . | |
| 4,934,149 | 6/1990 | DeVault et al. . | |
| 4,984,431 | 1/1991 | Mount et al. | 62/475 |
| 5,005,369 | 4/1991 | Manz . | |
| 5,022,230 | 6/1991 | Todack . | |
| 5,063,749 | 11/1991 | Manz . | |
| 5,086,630 | 2/1992 | Van Steenburgh, Jr. . | |
| 5,095,713 | 3/1992 | Laukhuf et al. . | |
| 5,099,653 | 3/1992 | Major et al. . | |
| 5,127,239 | 7/1992 | Manz et al. . | |
| 5,165,247 | 11/1992 | Rockenfeller et al. . | |
| 5,170,632 | 12/1992 | Reilly, Jr. et al. . | |
| 5,181,391 | 1/1993 | Manz . | |
| 5,187,940 | 2/1993 | Paxton . | |

OTHER PUBLICATIONS

"Solubility of Air in Freon–12 and Freon–22," H. M. Parmelee, Journal of the ASRE, Jun. 1951.

"How to Handle Multiple Refrigerants in Recovery and Recycling Equipment," ASHRAE Journal, Apr. 1991, pp. 22–30.

*Primary Examiner*—John M. Sollecito

*Attorney, Agent, or Firm*—Barnes, Kisselle, Raisch, Choate, Whittemore & Hulbert

[57] ABSTRACT

A refrigerant handling system that includes an air purge chamber and a refrigerant pump for directing refrigerant into the air purge chamber so that the refrigerant collects in liquid phase at a lower portion of the chamber while air and other non-condensibles collect in the vapor space at the upper portion of the chamber over the liquid refrigerant. A purge valve is connected to the upper portion of the chamber for automatically or manually purging air and other non-condensibles from the chamber. A refrigerant outlet is positioned at the lower portion of the chamber for drawing liquid phase refrigerant from the chamber. Desiccant adsorbent material is disposed in a canister connected to the upper portion of the air purge chamber for adsorbing refrigerant vapor in air passing through the canister. The desiccant adsorption material thus prevents venting of refrigerant vapor with non-condensibles from the air purge chamber.

19 Claims, 1 Drawing Sheet

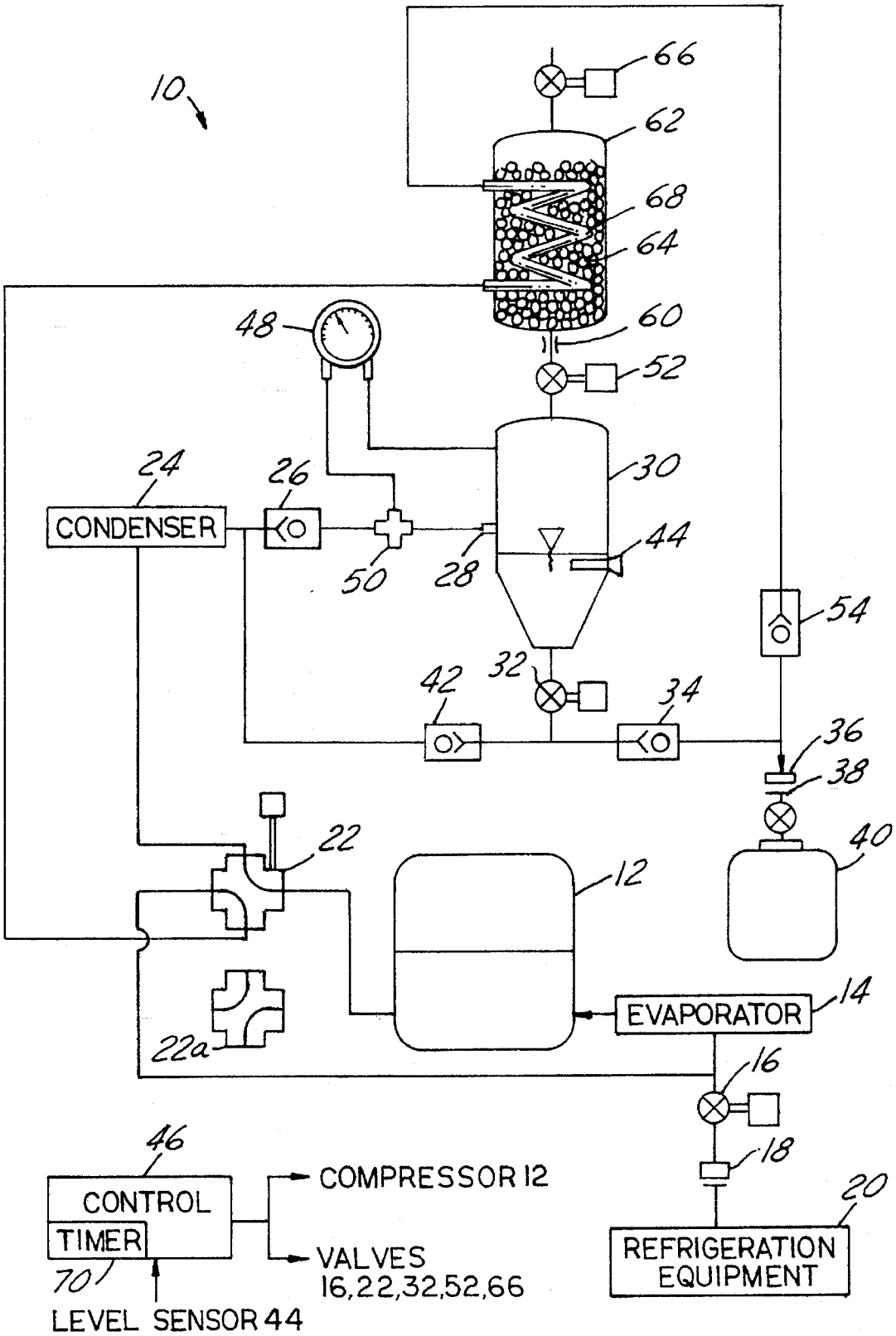
10
66
62
68
64
60
48
52
30
24
26
CONDENSER
50
28
44
54
32
42
34
36
38
22
40
12
EVAPORATOR
14
22a
16
18
46
CONTROL
TIMER
70
COMPRESSOR 12
VALVES
16,22,32,52,66
LEVEL SENSOR 44
20
REFRIGERATION
EQUIPMENT

REFRIGERANT HANDLING SYSTEM AND METHOD WITH AIR PURGE AND SYSTEM CLEARING CAPABILITIES

The present invention is directed to refrigerant handling systems and methods with facility for purging air and other non-condensibles from the refrigerant, and more particularly to an improvement in such systems and methods for preventing escape of refrigerant vapor along with the air and other non-condensibles during the purging operation.

BACKGROUND AND SUMMARY OF THE INVENTION

In systems for recovering refrigerant from refrigeration equipment under service, there have been a number of techniques proposed for removing or purging air from the recovered refrigerant. For example, in a system in which the refrigerant is pumped to a storage container by a compressor or liquid refrigerant pump, an air purge chamber may be connected between the refrigerant compressor or pump and the storage container for accumulating refrigerant in liquid phase at a lower portion of the chamber, and trapping air and other non-condensibles over the liquid refrigerant at the upper portion of the chamber. The trapped air and non-condensibles may be automatically or manually purged through a suitable valve when pressure becomes excessive.

U.S. application Ser. No. 08/100,424, assigned to the assignee hereof, now U.S. Pat. No. 5,367,886, discloses a refrigerant handling system that includes an air purge chamber and a refrigerant pump for directing refrigerant into the air purge chamber so that the refrigerant collects in liquid phase at a lower portion of the chamber while air and other non-condensibles collect in vapor phase at the upper portion of the chamber over the refrigerant. A purge valve is connected to the upper portion of the chamber for automatically or manually purging air and other non-condensibles from the chamber. A refrigerant outlet is positioned at the lower portion of the chamber for drawing liquid phase refrigerant from the chamber. A minimum level of liquid phase refrigerant is maintained at the lower portion of the chamber to isolate the outlet from the vapor space, and thereby prevent removal of air and other non-condensibles from the chamber through the outlet. Minimizing the liquid volume relative to the vapor volume reduces the amount of non-condensibles dissolved in the liquid phase refrigerant. A clearing valve is connected between the refrigerant pump and the air purge chamber, and may be selectively set in a clearing mode of operation such that the pump clears all refrigerant from the air purge chamber and directs such refrigerant to a refrigerant storage container.

In air purge systems of the described character, the vapor space above the liquid refrigerant in the air purge chamber will contain some refrigerant vapor, with the amount of such vapor depending upon the type of refrigerant, refrigerant temperature and vapor pressure within the air purge chamber. Thus, when the air purge chamber is vented to atmosphere, a small amount of refrigerant will be released into the atmosphere, deleteriously affecting the environment and necessitating the expense of make-up refrigerant. It is therefore a general object of the present invention to provide a system and method for refrigerant handling with air purge capabilities in which release of refrigerant vapor is prevented during the purging operation. Another object of the present invention is to provide a refrigerant handling system and method of the described character that include facility for clearing refrigerant from the handling system components, including the air purge chamber, preparatory to service on the system or employing the system in conjunction with a different refrigerant, and thereby preventing venting of the refrigerant to the atmosphere and inadvertent mixing and contamination of different types of refrigerant.

A refrigerant handling system in accordance with a presently preferred embodiment of the invention includes an air purge chamber and a refrigerant pump for directing refrigerant into the air purge chamber so that the refrigerant collects in liquid phase at a lower portion of the chamber while air and other non-condensibles collect in the vapor space at the upper portion of the chamber over the liquid refrigerant. A purge valve is connected to the upper portion of the chamber for automatically or manually purging air and other non-condensibles from the chamber. A refrigerant outlet is positioned at the lower portion of the chamber for drawing liquid phase refrigerant from the chamber. Desiccant adsorbent material is disposed in a canister connected to the upper portion of the air purge chamber for adsorbing refrigerant vapor in air passing through the canister. The desiccant adsorption material thus prevents venting of refrigerant vapor with non-condensibles from the air purge chamber.

In the preferred embodiment of the invention, the refrigerant pump mechanism comprises a compressor connected through a condenser to the air purge chamber, so that the condenser at least partially condenses refrigerant prior to entry into the air purge chamber. A check valve is connected at one end to a liquid refrigerant outlet from the air purge chamber, and at a second end between the condenser and the chamber inlet. The air purge chamber, the condenser and the desiccant canister may be selectively cleared of refrigerant by connection to the inlet of the compressor, so that operation of the compressor draws refrigerant from the condenser, and from the air purge chamber and desiccant canister through the check valve and the condenser. During such clearing mode of operation, the compressor outlet is connected through a refrigerant heat exchange coil disposed in the desiccant canister for heating the desiccant material and thereby promoting release of refrigerant adsorbed by the material.

BRIEF DESCRIPTION OF THE DRAWING

The invention, together with additional objects, features and advantages thereof, will be best understood from the following description, the appended claims and the accompanying drawing, which is a schematic diagram of a refrigerant recovery system in accordance with a presently preferred embodiment of the invention.

DETAILED DESCRIPTION OF THE PREFERRED EMBODIMENT

The drawing illustrates a refrigerant recovery system 10 in accordance with a presently preferred embodiment of the invention as comprising a refrigerant compressor 12 having an inlet connected through an evaporator 14 and a control solenoid valve 16 to a coupling 18 for connection to a source of refrigerant, such as refrigeration equipment 20 under service or a refrigerant storage container from which refrigerant is to be transferred. A solenoid-operated four-way clearing valve has a normal or de-energized configuration illustrated at 22, and an energized configuration illustrated at 22*a*. The outlet of compressor 12 is normally connected through valve 22 to a condenser 24 for at least partially condensing, and preferably substantially entirely condensing refrigerant passing therethrough. The outlet of condenser 24 is connected through a check valve 26 to the inlet 28 of an air purge chamber 30. An outlet port at the lower portion of chamber 30 is connected through a solenoid valve 32 and a check valve 34 to a coupling 36 for connection to a fitting 38 at the vapor port of a refrigerant storage container 40.

A check valve 42 is connected between the junction of solenoid valve 32 and check valve 34, and the outlet of condenser 24. A liquid level sensor 44 is operatively coupled to air purge chamber 30 to provide an electrical signal when a level of liquid refrigerant is below the sensor. Sensor 44, which may be of any suitable type, is connected to a control module 46, which controls operation of the compressor and the various solenoid valves. A differential pressure gauge 48 is connected to the vapor space of air purge chamber 30, and to a refrigerant bulb in a fitting 50 for heat transfer contact with refrigerant entering inlet 28 of air purge chamber 30. Gauge 48 indicates a need for purging air or other non-condensibles as disclosed in U.S. Pat. Nos. 5,005,369, 5,063,749 and 5,181,391 assigned to the assignee hereof. An air purge valve 52 may be either manually operated or automatically operated by control 46 for purging air and other non-condensibles from within air purge chamber 30.

To the extent thus far described, refrigerant recovery system 10 is as disclosed in above-noted application Ser. No. 08/100,424. During a recovery mode of operation, with clearing valve 22 in its normal position as shown and recovery control valve 16 open, compressor 12 pulls refrigerant through evaporator 14 from equipment 20 under service, and pumps such refrigerant through valve 22, condenser 24 and valve 26 to air purge chamber 30. When the level of liquid refrigerant within air purge chamber is at or above the level of sensor 44, control 46 opens valve 32 so that the liquid refrigerant at the lower portion of chamber 30 flows through check valve 34 and coupling 36 into storage container 40. When the level of liquid refrigerant within chamber 30 falls below the level of sensor 44, valve 32 is closed to prevent air and other non-condensibles collected at the upper portion of chamber 30 from entering storage container 40. During a clearing mode of operation, valve 22 is placed in the configuration **22*a* and solenoid valve 32 is opened. The compressor inlet is now connected through evaporator 14 and valve 22*a* to condenser 24, and from condenser 24 through check valve 42 and valve 32 to air purge chamber 30. The compressor 12 is operated to draw the refrigerant from the air purge chamber and condenser through evaporator 14, and to pump the refrigerant so cleared through valve 22*a* and a check valve 54 to storage container 40**.

In accordance with the illustrated embodiment of the present invention, solenoid valve 52 is connected through an orifice 60 to a canister 62 that contains a desiccant refrigerant adsorption material 64. Desiccant refrigerant adsorption material 64 may comprise activated carbon, a molecular sieve or other conventional sorbent material for capturing refrigerant vapor passing therethrough. An outlet at the upper portion of canister 62 is vented to atmosphere through a second purge control solenoid valve 66. A refrigerant coil 68 is disposed within canister 62, and is connected between clearing valve 22 and check valve 54 so that, when clearing valve 22 is in configuration **22*a* during a clearing mode of operation, refrigerant vapor from the outlet of compressor 12 passes through coil 68 to check valve 54 and storage container 40. In this way, during the clearing mode of operation, heat exchange between the refrigerant passing through coil 68 and desiccant material 64 exteriorly surrounding coil 68** heats the desiccant material and enhances release of adsorbed refrigerant.

During an air purge mode of operation when gauge 48 indicates excessive pressure of air and other non-condensibles within chamber 30, valves 52,66 are opened, and the non-condensibles within the upper portion of air purge chamber 30 are vented through desiccant chamber 62, together with any refrigerant vapor in the vapor space of the air purge chamber. This refrigerant vapor is captured by desiccant material 64, thereby preventing release of the refrigerant vapor to the atmosphere. Suction pressure of compressor 12 applied to coil 68 during the recovery mode of operation tends to cool the coil and the surrounding adsorbent material, thereby increasing adsorption properties of the adsorbent material. When the pressure within the air purge chamber vapor space decreases to the desired level, valves 52,66 are closed, and refrigerant recovery resumes. Orifice 60 controls the mass flow rate of air and refrigerant vapor through desiccant chamber 62. Controller 46 includes a timer 70 that accumulatively times of operation in the air purge mode, and thereby cooperates with orifice 60 to determine total mass flow through the desiccant material 64. Timer 70 indicates saturation of the desiccant material with adsorbed refrigerant, and a need for a clearing mode of operation.

During a clearing mode of operation preparatory to service on the refrigerant recovery system, use in conjunction with a different refrigerant, or removal of refrigerant adsorbed by desiccant material 64, valve 22 is placed in configuration **22*a*, valves 16,66 are closed and valves 32,52 are opened. When compressor 12 is energized, refrigerant is withdrawn from condenser 24, and from air purge chamber 30 through check valve 42 and condenser 24. Such refrigerant is pumped by compressor 12 through heat exchange coil 68 to storage container 40. Heat exchange coil 68 heats desiccant material 64, which releases adsorbed refrigerant to flow back through orifice 60 and valve 52 to air purge chamber 30, and thence is cleared by compressor 12 to storage container 40. Thus, the entire system, including the adsorbent material 64**, is cleared of refrigerant.

We claim:

1. A refrigerant handling system that includes: means forming an air purge chamber, means for directing refrigerant into said air purge chamber such that refrigerant collects in liquid phase at a lower portion of said chamber and non-condensibles collect at an upper portion of said chamber over the refrigerant, outlet means for drawing liquid phase refrigerant from said lower portion of said chamber, and means for purging the non-condensibles from said upper portion of said chamber, characterized in that said purging means comprises:

a canister, desiccant adsorption means disposed in said canister for adsorbing refrigerant vapor in non-condensibles passing through said canister, means for selectively venting said upper portion of said air purge chamber through said canister, such that said desiccant adsorption means prevents venting of refrigerant vapor with non-condensibles from said air purge chamber, means for cooling said desiccant adsorption means to enhance adsorption of refrigerant during operation of said venting means, and means for clearing refrigerant from said canister and said air purge chamber, including means for heating said desiccant adsorption means within said chamber to release refrigerant adsorbed by said desiccant adsorption means, said refrigerant directing means comprising a compressor, said heating means and said cooling means together comprising refrigerant heat exchange means disposed at said canister and operatively coupled to said compressor for drawing heat from said desiccant adsorption means in said canister in a first mode of operation of said system and adding heat to said desiccant adsorption means in said canister in a second mode of operation of said system.

2. The system set forth in claim 1 wherein said refrigerant directing means comprises a refrigerant compressor and means connecting an outlet of said compressor to an inlet of said air purge chamber while at least partially condensing refrigerant passing therethrough, said clearing means comprising a check valve connected between an outlet port at a lower portion of said chamber and said condensing means, and means connected between said compressor and said air purge chamber inlet for clearing refrigerant from said condensing means, said chamber and said canister through said check valve, such that compressor suction at said canister assists said heating means to release refrigerant adsorbed by said desiccant adsorption means.

3. The system set forth in claim 1 wherein said selectively venting means comprises an orifice for controlling mass flow rate of non-condensibles and refrigerant vapor through said canister.

4. The system set forth in claim 1 wherein said clearing means comprises means for connecting said canister and said chamber in series to an inlet of said compressor for drawing refrigerant from both said canister and said chamber, and means for connecting an outlet of said compressor to said heat exchange means to heat said desiccant adsorption means in said canister.

5. The system set forth in claim 4 wherein cooling means comprises means for connecting said heat exchange means to an inlet of said compressor to cool said desiccant adsorption means in said canister.

6. The system set forth in claim 5 wherein said heat exchange means comprises a refrigerant coil.

7. The system set forth in claim 6 wherein said refrigerant coil is disposed within said canister.

8. A method of purging non-condensibles from refrigerant comprising the steps of:

(a) directing the refrigerant into a chamber such that the refrigerant collects in liquid phase at a lower portion of the chamber and non-condensibles are trapped in the upper portion of the chamber over the liquid refrigerant, (b) selectively withdrawing refrigerant from an outlet at the lower portion of the chamber in a first mode of operation, (c) selectively purging non-condensibles trapped in the upper portion of said chamber in a second mode of operation through a desiccant adsorbent material to prevent venting of refrigerant vapor with non-condensibles from said air purge chamber, (d) cooling said desiccant adsorbent material to enhance refrigerant adsorbent capabilities of said material, and (e) determining saturation of said desiccant material with adsorbed refrigerant as a function of time duration of said step (c).

9. The method set forth in claim 8 comprising the additional steps of:

(d) clearing refrigerant from said chamber and said desiccant material, and (e) concurrently with said step (d), heating said desiccant material to enhance release of refrigerant adsorbed thereto.

10. A refrigerant handling system that includes:

means forming an air purge chamber, means for directing refrigerant into said air purge chamber such that refrigerant collects in liquid phase at a lower portion of said chamber and non-condensibles collect at an upper portion of said chamber over the refrigerant, outlet means for drawing liquid phase refrigerant from said lower portion of said chamber, and means for purging the non-condensibles from said upper portion of said chamber, characterized in that said purging means comprises:

a canister, desiccant adsorption means disposed in said canister for adsorbing refrigerant vapor in non-condensibles passing through said canister, means for selectively venting said upper portion of said air purge chamber through said canister, such that said desiccant adsorption means prevents venting of refrigerant vapor with non-condensibles from said air purge chamber, and means for clearing refrigerant from said canister and said air purge chamber, including means for heating said desiccant adsorption means within said chamber to release refrigerant adsorbed by said desiccant adsorption means, said refrigerant directing means comprising a refrigerant compressor and means connecting an outlet of said compressor to an inlet of said air purge chamber while at least partially condensing refrigerant passing therethrough, said clearing means comprising a check valve connected between an outlet port at a lower portion of said chamber and said condensing means, and means connected between said compressor and said air purge chamber inlet for clearing refrigerant from said condensing means, said chamber and said canister through said check valve, such that compressor suction at said canister assists said heating means to release refrigerant adsorbed by said desiccant adsorption means.

11. The system set forth in claim 10 wherein said refrigerant directing means comprises a compressor, and wherein said heating means and said cooling means together comprise refrigerant heat exchange means disposed at said canister and operatively coupled to said compressor for drawing heat from said desiccant adsorption means in said canister in a first mode of operation of said system and adding heat to said desiccant absorption means in said canister in a second mode of operation of said system.

12. The system set forth in claim 10 wherein said means for heating said desiccant adsorption means comprises refrigerant flow means in heat exchange with said desiccant adsorption means and means for selectively connecting said compressor outlet to said refrigerant flow means.

13. A refrigerant handling system that includes: means forming an air purge chamber, means for directing refrigerant into said air purge chamber such that refrigerant collects in liquid phase at a lower portion of said chamber and non-condensibles collect at an upper portion of said chamber over the refrigerant, outlet means for drawing liquid phase refrigerant from said lower portion of said chamber, and means for purging the non-condensibles from said upper portion of said chamber, characterized in that said purging means comprises:

a canister, desiccant adsorption means disposed in said canister for adsorbing refrigerant vapor in non-condensibles passing through said canister, and means for selectively venting said upper portion of said air purge chamber through said canister, such that said desiccant adsorption means prevents venting of refrigerant vapor with non-condensibles from said air purge chamber, said selectively venting means comprising an orifice for controlling mass flow rate of non-consendible and refrigerant vapor through said canister.

14. The system set forth in claim 13 further comprising means for determining saturation of said desiccant adsorption means with adsorbed refrigerant as a function of time duration of venting non-condensibles and refrigerant vapor through said canister.

15. A method of purging non-condensibles from refrigerant comprising the steps of:

(a) directing the refrigerant into a chamber such that the refrigerant collects in liquid phase at a lower portion of the chamber and non-condensibles are trapped in the upper portion of the chamber over the liquid refrigerant;

(b) selectively withdrawing refrigerant from an outlet at the lower portion of the chamber in a first mode of operation, (c) selectively purging non-condensibles trapped in the upper portion of said chamber in a second mode of operation through a desiccant adsorbent material to prevent venting of refrigerant vapor with non-condensibles from said air purge chamber, and (d) determining saturation of said desiccant material with adsorbed refrigerant as a function of time duration of said step (c).

16. The method set forth in claim 15 comprising the additional steps of:

(e) clearing refrigerant from said chamber and said desiccant material, and (f) concurrently with said step (e), heating said desiccant material to enhance release of refrigerant adsorbed thereto.

17. The method set forth in claim 15 comprising the additional step of: (d) cooling said desiccant adsorbent material to enhance refrigerant adsorbent capabilities of said material.

18. A refrigerant handling system that includes: means forming an air purge chamber, means for directing refrigerant into said air purge chamber such that refrigerant collects in liquid phase at a lower portion of said chamber and non-condensibles collect an an upper portion of said chamber over the refrigerant, outlet means for drawing liquid phase refrigerant from said lower portion of said chamber, and means for purging the non-condensibles from said upper portion of said chamber, characterized in that said purging means comprises:

a canister, desiccant adsorption means disposed in said canister for adsorbing refrigerant vapor in non-condensibles passing through said canister, means for selectively venting said upper portion of said air purge chamber through said canister, such taht said desiccant adsorption means prevents venting of refrigerant vapor with non-condensibles from said air purge chamber, and means for determining saturation of said desiccant adsorption means with adsorbed refrigerant as a function of time duration of venting non-condensibles and refrigerant vapor through said canister, said selectively venting means comprising means for controlling mass flow rate of non-condensibles and refrigerant vapor through said canister.

19. The system set forth in claim 18 wherein flow rate controlling means comprises an orifice.

* * * * *